US011837204B2

(12) United States Patent
Skillings

(10) Patent No.: US 11,837,204 B2
(45) Date of Patent: Dec. 5, 2023

(54) INSTRUMENT STAND SYSTEM

(71) Applicant: Small Stage LLC, Whitinsville, MA (US)

(72) Inventor: Steve Skillings, Whitinsville, MA (US)

(73) Assignee: Small Stage LLC, Whitinsville, MA (US)

( * ) Notice: Subject to any disclaimer, the term of this patent is extended or adjusted under 35 U.S.C. 154(b) by 150 days.

(21) Appl. No.: 17/674,155

(22) Filed: Feb. 17, 2022

(65) Prior Publication Data

US 2022/0270575 A1 Aug. 25, 2022

Related U.S. Application Data

(60) Provisional application No. 63/151,925, filed on Feb. 22, 2021.

(51) Int. Cl.
*G10G 5/00* (2006.01)
*G10D 3/00* (2020.01)

(52) U.S. Cl.
CPC ..... *G10G 5/00* (2013.01); *G10D 3/00* (2013.01)

(58) Field of Classification Search
None
See application file for complete search history.

(56) References Cited

U.S. PATENT DOCUMENTS 3,737,137 A * 6/1973 Sheehan ..... A47B 97/04 248/441.1
3,765,633 A * 10/1973 Caudill ..... G10G 5/00 248/447.2
4,084,778 A * 4/1978 Dominguez ..... G10G 5/00 248/314
4,991,809 A 2/1991 Harkey
7,541,529 B1 6/2009 Blair
7,659,468 B1 2/2010 Gottlieb
2005/0000348 A1 1/2005 Workman
2006/0032359 A1* 2/2006 Smith ..... G10G 5/00 84/327
2007/0125222 A1* 6/2007 Clifford ..... G10G 5/00 84/327
2008/0028913 A1 2/2008 Driscoll
2012/0032052 A1 2/2012 Lewis et al.
2021/0256945 A1* 8/2021 Micco ..... G10D 1/08
2022/0270575 A1* 8/2022 Skillings ..... G10G 5/00

FOREIGN PATENT DOCUMENTS

WO WO-03042970 A1 * 5/2003 ..... G10G 5/00

OTHER PUBLICATIONS

International Search Report and Written Opinion, PCT Application No. PCT/US2022/016734, dated Jun. 2, 2022 (7 pages).

* cited by examiner

*Primary Examiner* — Steven M Marsh
(74) *Attorney, Agent, or Firm* — Occhiuti & Rohlicek LLP

(57) ABSTRACT

A manufacture for supporting a guitar having a neck and a base that extends downward from a distal end of said neck, the apparatus comprising a neck cradle and a leg that comprises a first section, the first section extending downward from the neck cradle, wherein the neck cradle comprises a first face, a second face, and a third face that is opposite the second face, wherein the first section of the leg comprises a first surface, and wherein the first face comprises a curved section that extends between the second and third faces and that supports a neck of a guitar, as a result of which, when the first face supports the guitar, there exists a force vector having first and second components.

17 Claims, 5 Drawing Sheets

INSTRUMENT STAND SYSTEM

CROSS-REFERENCE TO RELATED APPLICATIONS

This application claims priority to U.S. Provisional Application Ser. No. 63/151,925, filed on Feb. 22, 2021, incorporated herein by reference.

BACKGROUND

This invention relates to musical instrument stands.

Most musical instruments are shaped with a lot of round surfaces and they do not have a center of gravity that allow them to stand stably on their own. Because of this, companies have created metal and wood "stands" that allow the instrument to be held "vertically", or stand like a person, by a mechanism or two that supports the unstable standing position of the instrument. For many stands to be stable, they have a wide base or legs that spread out to make a wide base, thus they take up a lot of space on stage or in a room.

Sometimes musicians seek to stand their guitars without the use of a large, wide stand, by leaning them on the side of a table, or against an amplifier. When doing so, the instrument is very unstable and any bump, breeze, or vibration could cause the instrument to fall to the ground and be damaged.

Because it is desirable to stand the guitar temporarily while recording or playing, products have been created to better secure the instrument while setting it down on its end and leaning it against an object, so as to not have to use a large stand. These products are often made to be removable since modifying the amplifier or table with screws, glue or some other permanent adhesive is not desirable. These products provide stability by being placed on the amplifier or table and a feature protruding from the device is present to cradle the neck of the instrument and providing temporary stability when leaning the instrument against a table or amplifier. These instrument cradles come in two basic forms, stability by friction/mass and stability by clamps.

In the case of a stability by friction device, the device is made with two flat surfaces at a 90-degree angle to one another, one horizontal, one vertical, relative to gravity. When the instrument is leaned against the device's neck cradle, the force created by leaning the instrument holds the device in place by the friction created between the vertical face of the device and the vertical face of the amplifier or table. However, the problem with this device is that once you remove the instrument, the device is free to move around without restriction as there is little normal force being created by the device's mass. It is often the case that when in use, should the user remove the instrument slightly askew, the forces on the device from the instrument will cause the device to be knocked sideways and likely fall from the table or amplifier. In some cases, the device may have a cup shaped area for storing picks/plectrum and when the device falls, the picks are likely to fall out of the cup area and onto the floor, usually on a trajectory that is enhanced by the lever arm created by the front face being a pivot point, scattering picks across the area.

With the device that uses additional mass to create stability, the "friction for stability" concept is still used, but enhanced stability is created by an additional mass which has been inserted into the device. The added mass is usually a metal block inside the device giving it a greater normal force on the horizontal face, therefore greater friction, but the same normal force on the vertical face, if it deploys the vertical face strategy, some products do not. However, the same problem of instability occurs when adding or removing the instrument from the cradle area, any amount of side force not perpendicular to the curved neck cradle area that is greater than the mass's normal force, can cause the device to move undesirably and/or fall to the floor as with the prior design style. Friction alone depends on the ratio of normal force generated, vs. lever arm force of removing or adding the instrument into the cradle for its ability to be stable during insertion and removal of the instrument, or an unintended side force by the musician or a pet or the wind.

Another method for creating stability for the device uses a clamping system that uses a screw thread mechanism. It directly addresses the device falling problem of a friction-only design by using a compression clamp to create the additional stability desired. This style of product uses a screw and plate style compression clamp that squeezes the tabletop, so that the device is firmly in place whether it's in use, or when unused, greatly improving stability. However, this clamping mechanism has fewer applications because it needs two parallel faces (usually horizontal) to squeeze in order to generate the friction needed to hold the device in place when an instrument present or not present. A table or desk is often the best use case for this clamping design, but some embodiments are large enough for a guitar amplifier, which is often a large wooden box. Amplifiers are often covered with a vinyl covering called "Tolex" that is decorative, or finished wood with polyurethan to protect the look. There is a high likelihood that the clamp will damage the wood and covering/paint due to the clamping forces required, and the lever arms created by the long clamps. This makes the clamping style limited in its applications and undesirable for instrument stands used with amplifiers.

None of these devices provide stability to the bottom of the guitar which can easily slide sideways and create instability, even the point where the instrument falls over as its center of gravity moves sideways of the post and becomes unstable.

SUMMARY

The invention relates to a stand that instruments lean against that assists in creating stability while holding the instrument in a vertical position, and the device remains stable as the instrument is removed or added or when the instrument bumped.

With the above background in mind, it is a primary objective of the present invention to provide an improved approach for an attachable and removable stand system for instruments. It is another objective to allow the system to connect firmly to the amplifier or table without the use of materials and methods that would harm the surface of the table or amplifier. It is another objective that the device is stable and attached to the table or amplifier when an instrument is not present. It is another objective to optimize for portability with a light as possible device. It is another objective to create a device that can be transported as one piece, or multi-piece, depending on the ultimate application of the device. It is another objective to use the force created by the leaning instrument to optimize pressure on the microsuction component, when used. It is another objective to allow for optimized shapes and sizes of the vertical member for different applications. It is another objective to create a base for applications where the floor may be hard or additional stability at the bottom of the instrument is advantageous. It is another objective to create useful secondary features like pick holders and cable holders that enhance the value and functionality of the product.

These objectives are accomplished by having a detachable stand system for instruments that can be mounted and removed readily. This invention uses unique shapes and a layer of microsuction to provide stability for the instrument when in place, and for remain ready for use when the instrument is being played by the owner. The user places the invention on their amplifier or tabletop by aligning the vertical face of the device to one of the vertical faces of the tabletop or amplifier, and the horizontal face on top of the amplifier or tabletop. Then, they press the device against the amplifier or tabletop at a 45-degree angle to engage the micro-suction and create a gripping force created by the suction cups in the microsuction material. With the device firmly attached to the amplifier or tabletop, the user's instrument can be rested against the device which cradles the neck shape and holds the instrument in place securely. When sitting, the instruments neck creates a small, steady force to keep the micro-suction engaged and adhered. Upon removing the instrument, the device remains in place due to the grip of the vertical and horizontal faces and the microsuction material holding firmly. In some embodiments the device also has a feature for holding picks, or drink cans, with other features for holding cables in place. It is desirable with some instrument shapes, to remove the cable when the instrument is "standing" due to the protruding cable hitting the floor and creating instability. For some use cases, a hard wood or hard tile floor may be where the amplifier or tabletop rests, so having a base is desirable to add stability to the often-rounded shape of instruments, or for those instruments that have a strap button on them. The base works in concert with the device to create stability and security. The base, in some embodiments, also has microsuction layer to enhance stability. It is often desirable to remove the stand device from the amplifier for transportation, or the tabletop to create more works space, and the device is designed to accommodate this by allowing the user to flex the device and peel it from the amplifier or tabletop. This peeling motion reduces the resistive forces of the microsuction by pulling them off one row at a time, versus pulling parallel to the faces and trying to detach the microsuction all at once. In the case of a two-piece design, the vertical leg can be removed and the two sections of the device place in a bag for improved transportation.

The described structure may come in a plurality of shapes, materials and sizes to accommodate a plurality of instruments, amplifiers, tabletops and floors.

The features of the present invention which are believed to be novel are set forth in this application and in particular, in the appended claims. Other objectives and many of the features of this invention will be more readily appreciated and understood by reference to the following detailed descriptions and diagrams.

Other features and advantages of the invention are apparent from the following description, and from the claims.

DESCRIPTION

Figure 1:
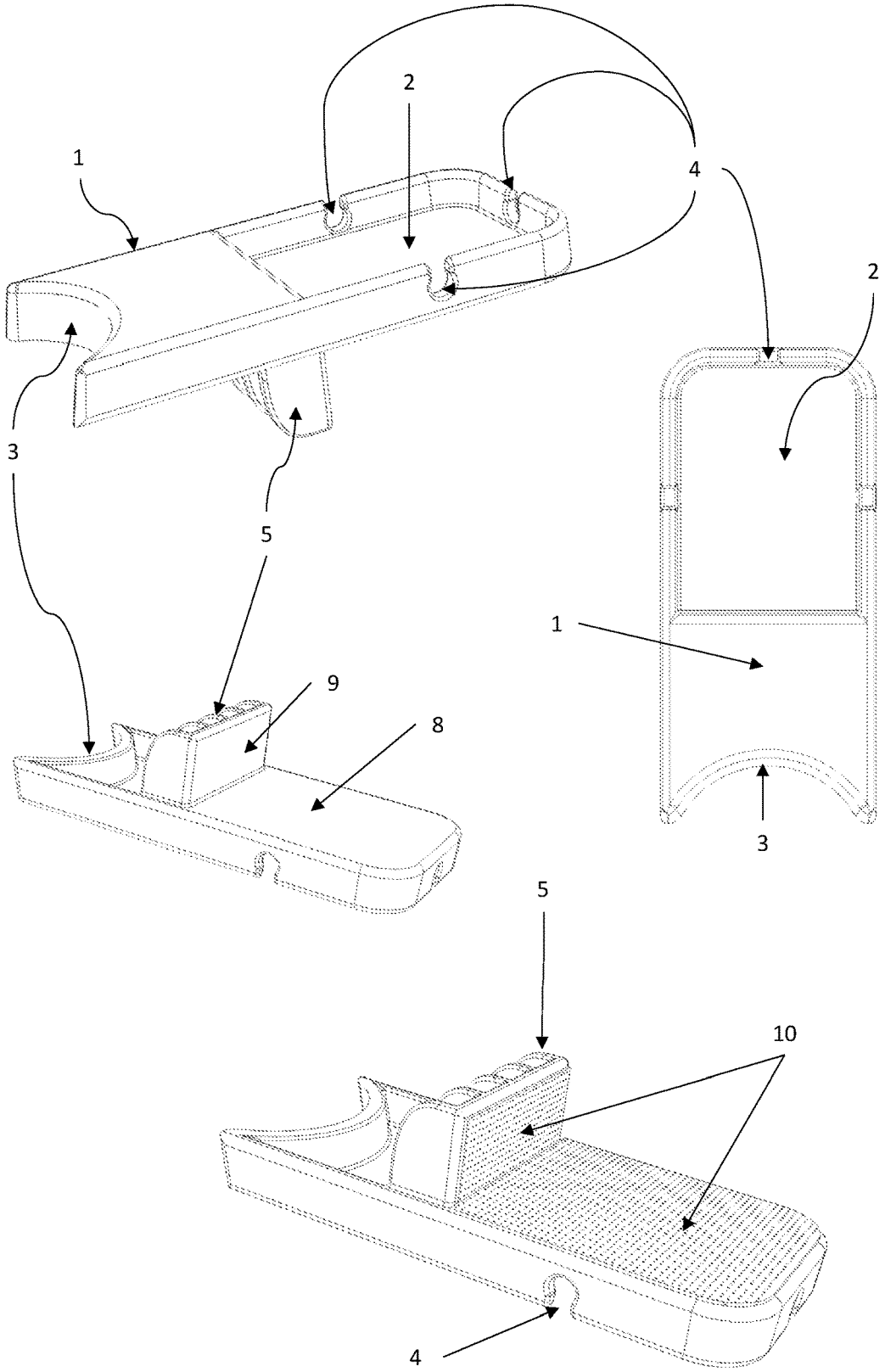
FIG. 1 is a view of the stand system showing a one-piece design.

FIG. 1 shows the device 1 in an embodiment where the device is a single molded piece with a cup shaped area for picks 2 and a curved and angled face 3 for cradling the guitar neck as the guitar leans against the device 1. The horizontal face 8 is set on top of an amplifier or table where the vertical leg 5 has a face 9 that rests against the side of the amplifier or table. The horizontal and vertical faces have a layer of microsuction 10 that the musician uses to "stick" the device in place, and yet allows the device to be removed readily. The design uses the forces generated by the guitar leaning against the stand neck cradle 3 to transfer a normal force into the microsuction covered faces, 8 and 9, reinforcing the holding force of the microsuction 10 with each use. A useful addition to the device is a cable holding feature 4 which assists in holding an instrument cable in place when the cable is not in use. This feature may be used in one or more places and can create additional functionality when two or more are aligned across from one another, creating a natural bending point in the device 1 for removing the device using a peeling motion for when it is not needed or wanted on the amplifier or tabletop. The device may be held in place by any number of materials such as microsuction tape, two-sided adhesive tape, Velcro, or any other removable or reusable products as known to those knowledgeable in the art. The device in most embodiments is made from a thermoplastic elastomer (TPE), thermoplastic urethane (TPU), or thermoplastic rubber (TPR), as these materials allow the device to be readily flexible in the shown design shape and construction. However, in other embodiments, the device may be made of wood or metal, and have features that allow these stiffer materials to flex for improved removal. Similarly, embodiments may have sliding or fastener features that allow the vertical member 5 to be easily detached, as in FIG. 5, for removal and attachment of the device to the amplifier or tabletop. The material of choice is dependent on the preferences of the consumer and application; many types of materials and corresponding designs can be used by those knowledgeable in the art.

Figure 2:
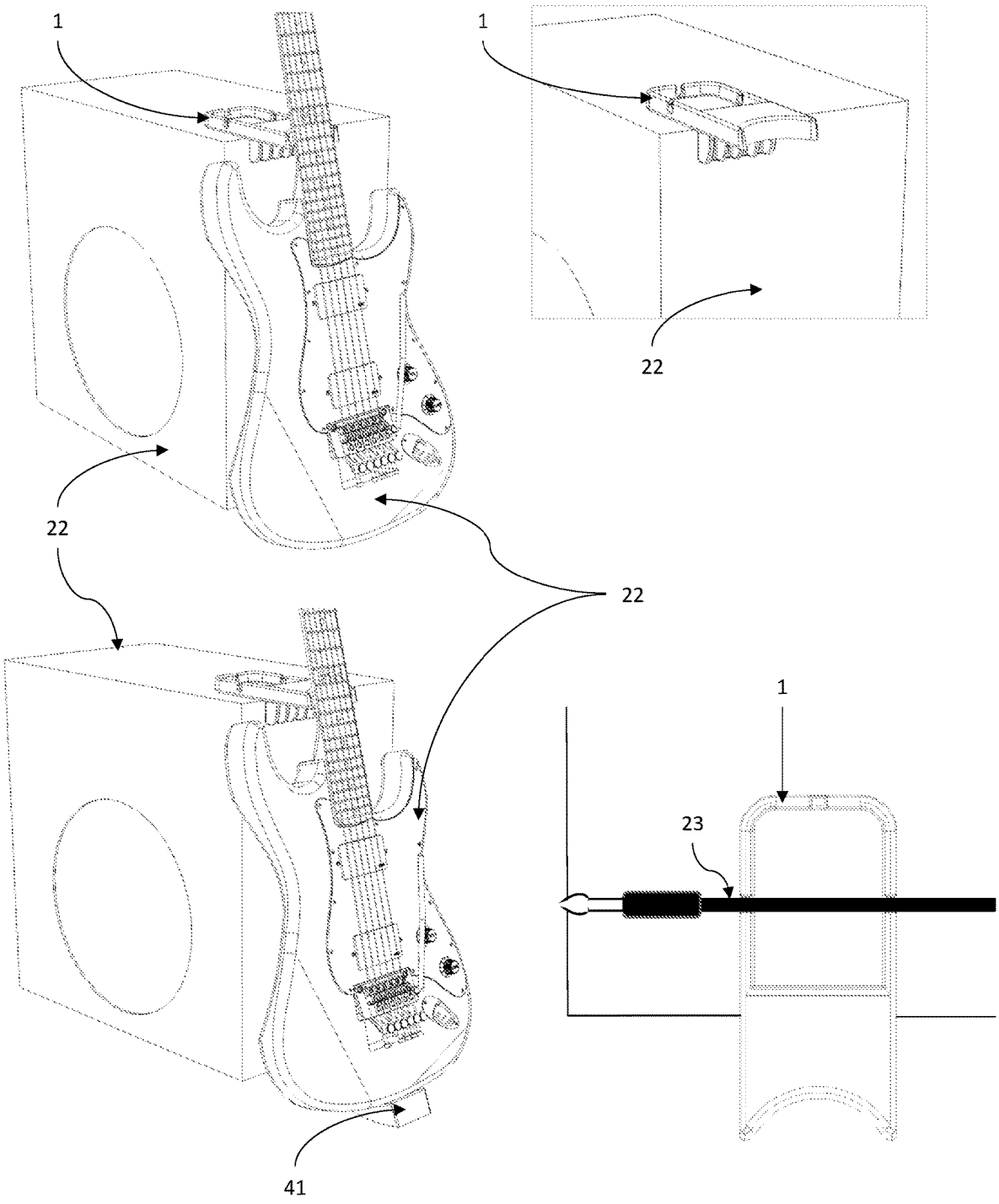
FIG. 2 is a view of the stand system connected to a guitar amplifier with a guitar leaning against the device and shows an optional base component and optional cable capture features.

FIG. 2 shows a view of the device as it might be used by a musician in their studio, home or at a performance. The device 1 has been attached to an amplifier 22 using the microsuction 10 by aligning the vertical 9 and horizontal 8 faces to the faces of the amplifier 22 and pressing down at a 45-degree angle to engage the micro-suction 10. The guitar 21 is then leaned against the device 1 and the neck cradle 3 prevents the instrument from falling over. The neck cradle is designed at an angle to maximize the holding friction on the guitar neck by maximizing the contact surface area, and to transfer the maximum amount of force from the leaning guitar to the microsuction 10. The neck cradle may be more or less flexible than the rest of the design, via materials or shape, to maximize clamping force or rigidity of the cradle, depending on the needs of the instrument and the application. FIG. 2 also shows how the cable holding feature 4 works when shown from a top view. Likewise, FIG. 2 shows the optional stand base component in application. The base is detailed in FIG. 4.

Figure 3:
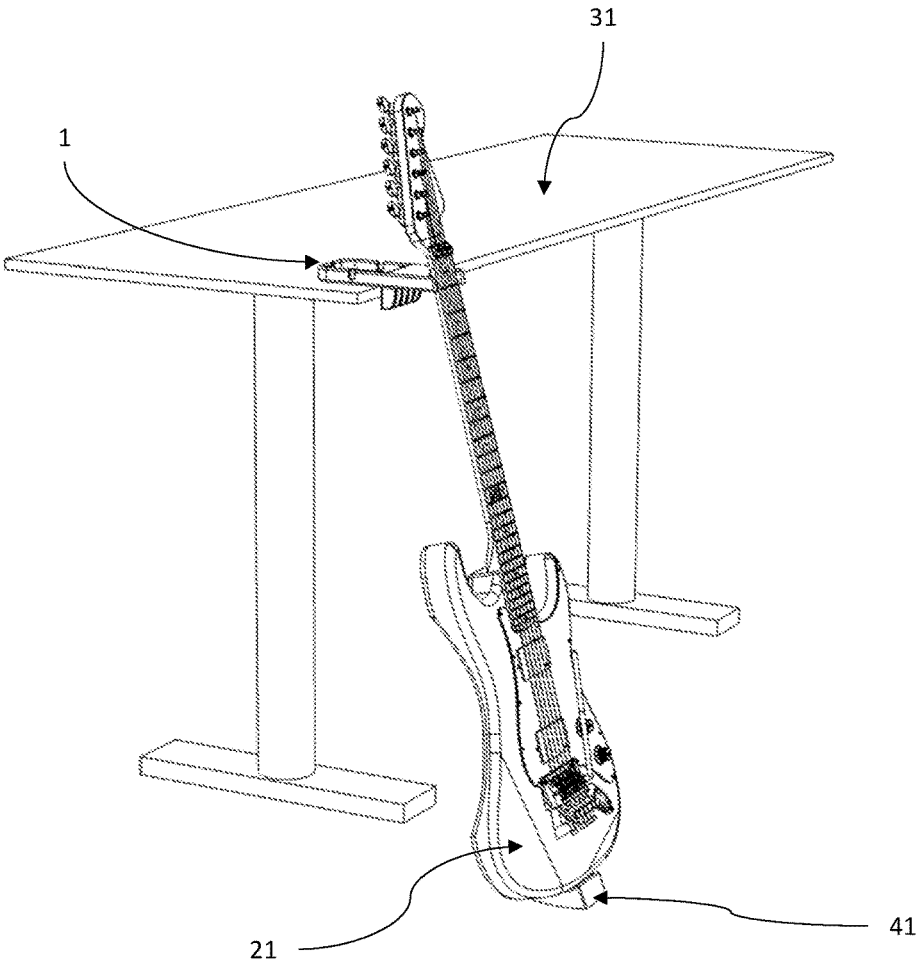
FIG. 3 is a view of the stand system connected to a table and the optional base component.
Figure 3:
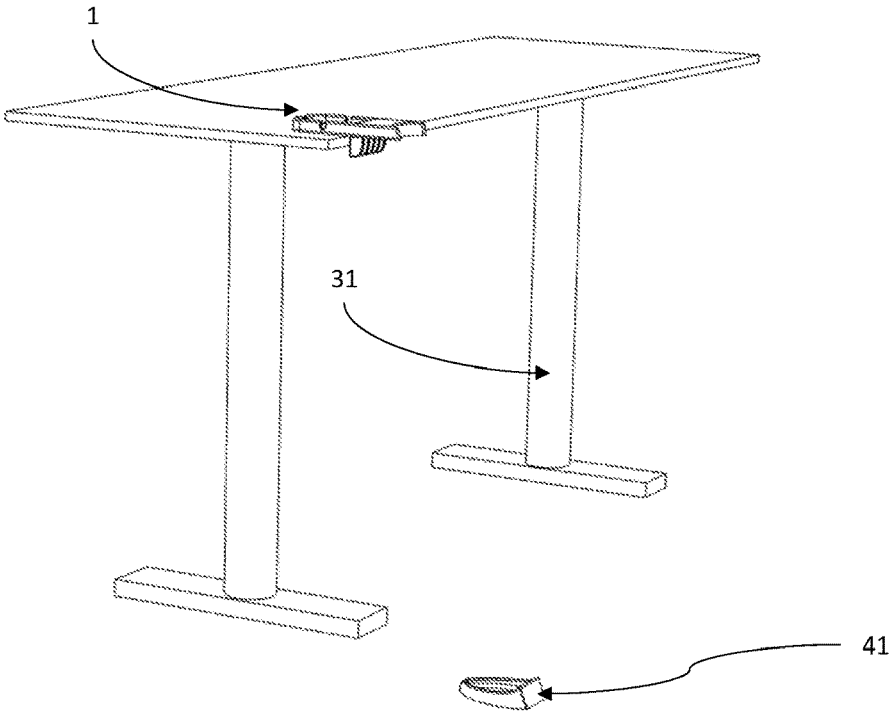

FIG. 3 shows a detailed view of the device 1 when used on a thinner surface, such as a tabletop 31 in a recording studio with a guitar in place. It shows a second view of the device 1 and the optional base 41 without the guitar in place.

Figure 4:
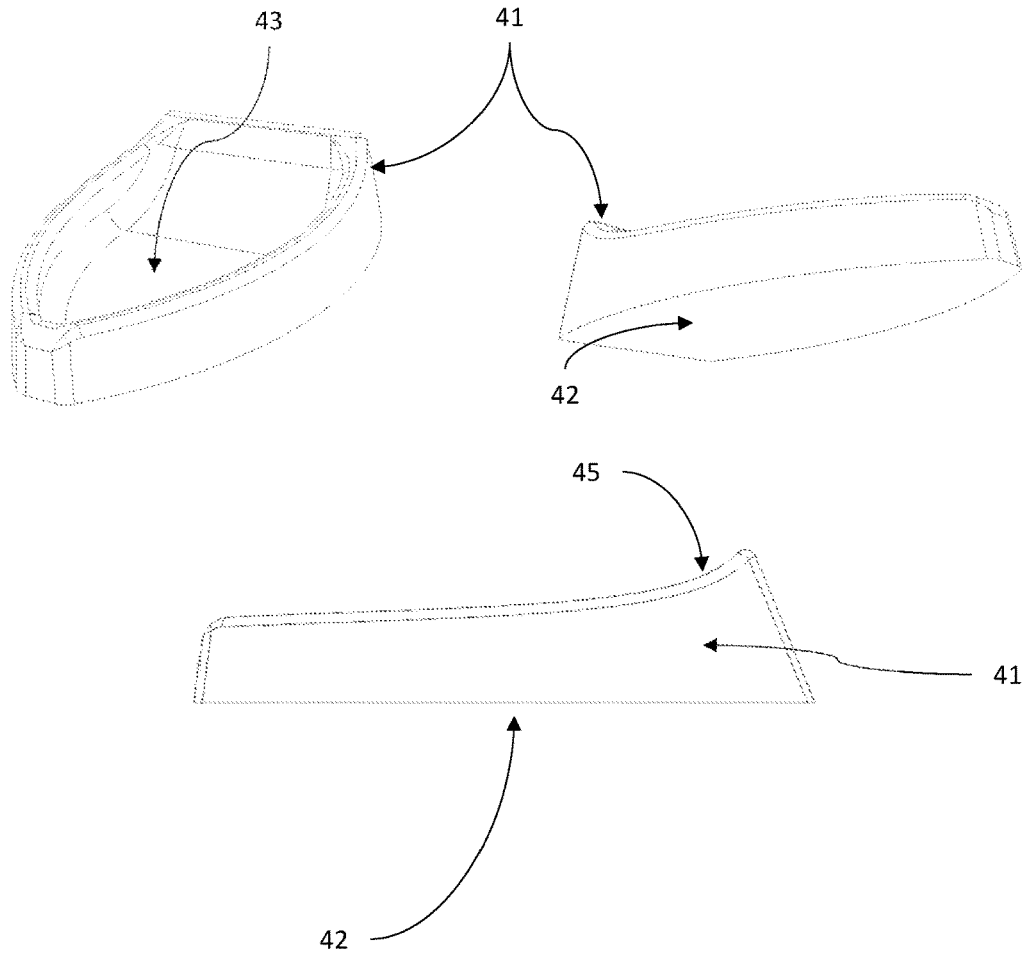
FIG. 4 shows a view of a stand system base component.
Figure 4:
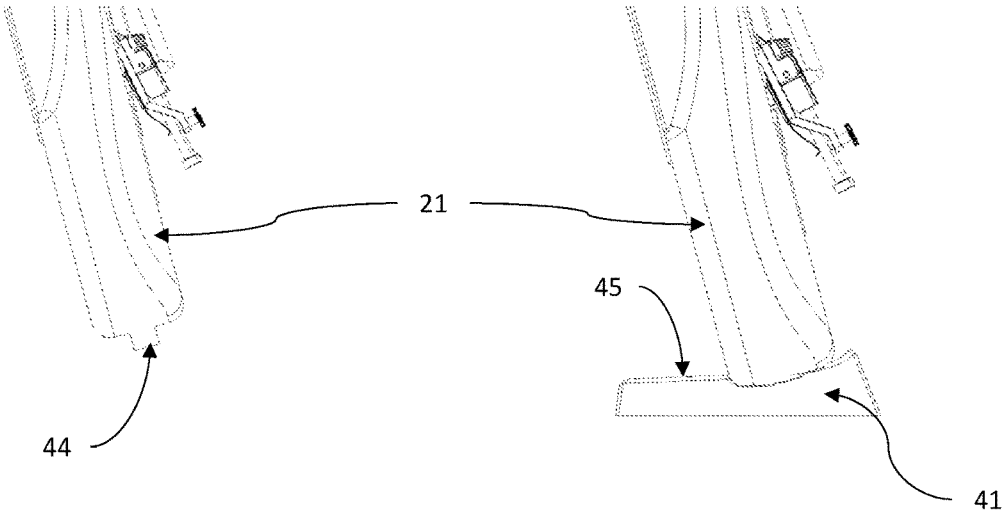

FIG. 4 shows a detailed view of a base 41 design for the device. In some applications the amplifier 22 or table 31 may be placed on a hard surface, like a tile floor, thus rendering the stability of the guitar's bottom as insufficient to stand alone or survive a small bump without sliding away, or falling over, and damaging the instrument. While carpets, rugs, and other soft materials are often used in studios and homes to absorb sound, at performances the floor is often wood or some other hard surface material, and these materials minimize the friction required to reliably hold the base of the guitar in place. Many instruments 21 have a strap holding protrusion called a "strap button" 44 that is typically made of a rigid material like metal, held in place with a screw, and rounded on the edges to accommodate the easy addition and removal of the strap. The strap button 44 creates a small contact area on the floor for the instrument 21 and makes the instrument standing on hard surfaces unstable. Yet the button 44 acts as a "spear" on carpets, providing greater stability when the device 1 is used with a carpeted floor. The bottom of the base 41 may also have a layer of microsuction applied to its bottom 42 to create greater holding power against accidental bumps and/or adding or removing the instrument at an awkward angle when placing it down in the stand hastily. The bottom 42 may contain features meant to generate traction, like those on the bottom of a shoe. In this embodiment the base is formed with a curved face shape 45 designed to optimize the holding force no matter what the insertion angle is of the instrument. In this embodiment, the base has a cupped area 43 to allow relief for the strap button 44 and to optimize moldability to lower the cost of production. In this embodiment, the base 41 is made wide enough to allow a standard guitar strap to remain on the instrument without coming between the base 41 and the instrument 21, in order to maximize stability of the instrument when set on the base 41. The base 41 may be made from a flexible material or a rigid material, similar to the device 1, depending on the desired application for the base 41 and the device 1. The base 41 and the device 1, may be made of the same material, or different materials, depending on the desired features needed for a plurality of applications. Different materials, and manufacturing techniques, can be applied to a plurality of embodiments of the base 41 by those known to those knowledgeable in the art.

Figure 5:
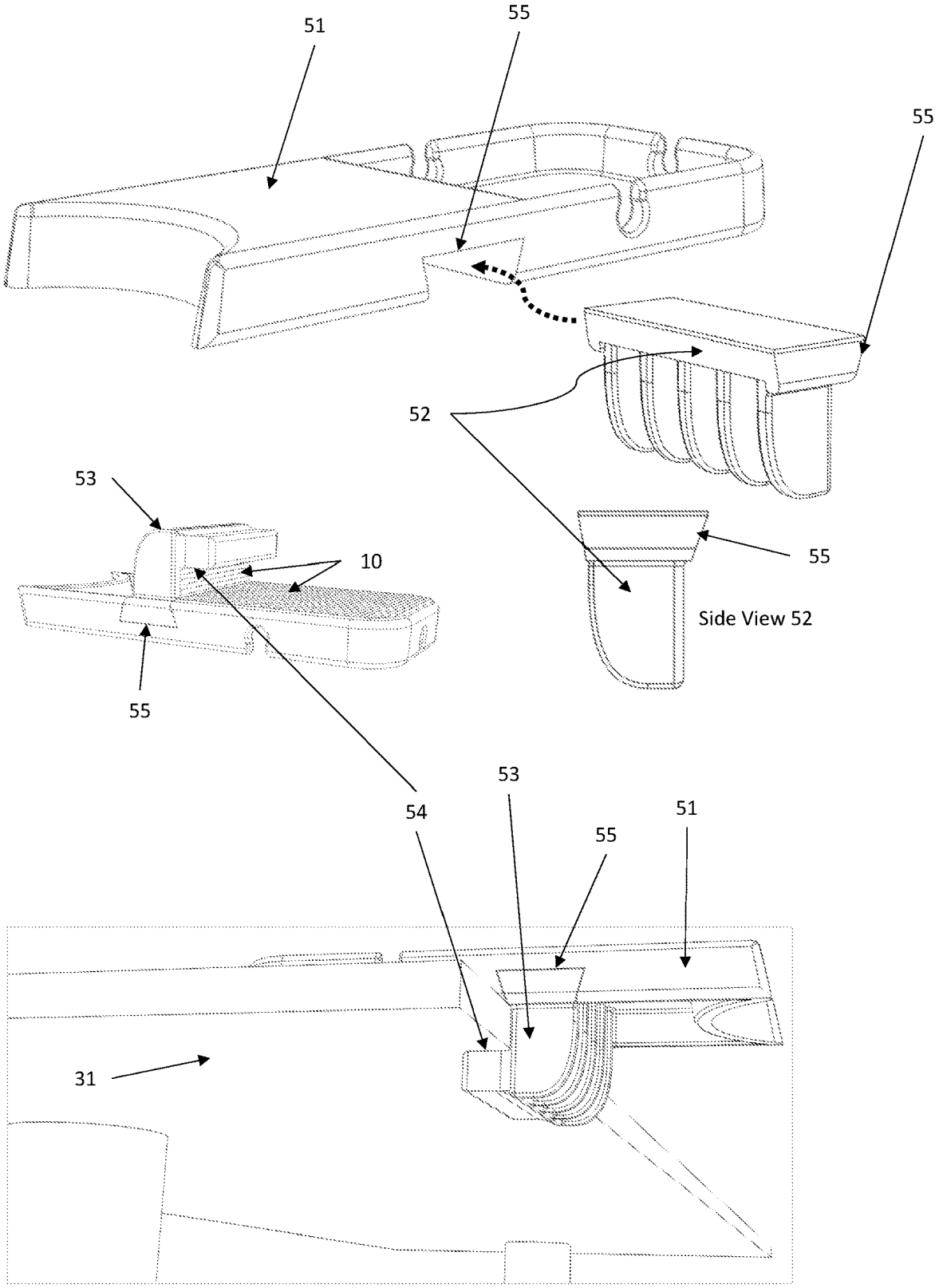
FIG. 5 shows a view of the stand system as a multi-piece design.

As shown in FIG. 5, the device 1 may be made of a multi-piece design to allow for a plurality of features such as easier storage in travel, shipping efficiencies, material optimization, ease of removal when in use, ease of setup, and any plurality of capabilities known by those knowledgeable in the art of a modular, multi-piece design. In a multi-piece design embodiment, the device 51 may have a locking mechanism, or sliding mechanism, to allow for easy assembly of the multi-piece design's horizontal face component 51 and its vertical leg component 52. Using simple features such as locking keys shapes, rotating features, snap fits, and any plurality of connection methods known to those knowledgeable in the art, the device can be assembled and disassembled quickly and without tools. However, using a screw, pin, quarter-turn fastener, or similar fastener method may be advantageous for some embodiments and is anticipated. In the example of a sliding key shape, the horizontal component 51 has a dovetail shape in the device to accommodate the matching dovetail shape 55 in the vertical leg 52 which slides in and out. Having a multi-piece design also allows for application customization where desired. For example, FIG. 5 shows two different leg designs, 52 and 53. The leg depicted in item 53 uses the same dovetail feature of component 52 but has a different profile and design shape. Component 53 has been optimized for 0.5" tabletop use by creating a face 54 to grab under a standard 0.5" thick recording studio desk. In this embodiment, the holding force is greatly enhanced through the use of a two-parallel-faces design and optimized for recording studio users. A user may wish to have both types of vertical legs, 52 and 53, at their disposal and a multi-piece design allows for a plurality of application specific vertical legs to be used to optimize performance of the stand device.

In some embodiments, the face 54 is padded to avoid marring the surface against which it is held by the holding force. In such embodiments, it is useful for the downwardly-facing face of the horizontal component 51 to likewise be padded.

It is apparent that the structural features of the invention can be obtained by a variety of materials and construction methods to those knowledgeable in the art.

It is to be understood that the foregoing description is intended to illustrate and not to limit the scope of the invention, which is defined by the scope of the appended claims. Other embodiments are within the scope of the following claims.

What is claimed is:

1. A manufacture for supporting a guitar having a neck and a base that extends downward from a distal end of said neck, said manufacture comprising a neck cradle and a leg that comprises a first section, said first section extending downward from said neck cradle, wherein said neck cradle comprises a first face, a second face, and a third face that is opposite said second face, wherein said first section of said leg comprises a first surface, and wherein said first face comprises a curved section that extends between said second and third faces and that supports a neck of a guitar, as a result of which, when said first face supports said guitar, there exists a force vector having first and second components that are perpendicular to each other, said first component being directed downwardly and perpendicular to said second face and said second component being directed perpendicular to said leg in a direction away from said neck.

2. The manufacture of claim 1, wherein said first surface is beveled at an angle that conforms to an angle at which said guitar leans, thereby maximizing contact between said first surface and said neck.

3. The manufacture of claim 1, wherein said third face comprises a notch for accommodating a cable.

4. The manufacture of claim 1, wherein said leg is fixed to said neck cradle.

5. The manufacture of claim 1, wherein said leg is separable from said neck cradle.

6. The manufacture of claim 1, wherein said cradle comprises a groove that accommodates said leg.

7. The manufacture of claim 1, wherein said third surface forms a recess for accommodating items.

8. The manufacture of claim 1, further comprising a base support and a third suction surface, wherein said base support has a top side and a bottom side, wherein said top side supports said base of said guitar and wherein said third suction surface on said bottom side.

9. The manufacture of claim 8, wherein said top side includes a recess to accommodate a strap button of said guitar.

10. The manufacture of claim 1, wherein said leg comprises a second section that extends from said first section in a direction away from said guitar.

11. The manufacture of claim 1, wherein said leg is separable from said neck cradle, wherein said leg is a first leg, wherein said manufacture comprises a second leg that is separable from said neck cradle, wherein said second leg includes a first section that, when said second leg is attached to said neck cradle, extends downward from said neck cradle and a second section that extends from said first section in a direction away from said guitar.

12. The manufacture of claim 1, further comprising first and second suction surfaces, wherein said first suction surface is disposed on said first surface and said second suction surface is disposed on said second face.

13. The manufacture of claim 1, further comprising padding on at least one of said first and second surfaces.

14. The manufacture of claim 1, further comprising padding on said first and second surfaces.

15. The manufacture of claim 1, wherein said leg comprises a second section that extends from said first section in a direction away from said guitar, wherein there exists a gap between said first section and said second section and said second face, whereby in response to a clamping force, said second section and said first surface are clamped to a ledge that is inserted in said gap.

16. The manufacture of claim 15, wherein said gap comprises a surface, at least a portion of which is padded.

17. The manufacture of claim 15, wherein said gap comprises a pad surface.

* * * * *